US006112356A

United States Patent [19]

Hashey

[11] Patent Number: 6,112,356

[45] Date of Patent: Sep. 5, 2000

[54] DISPOSABLE FINGER-MOUNTED TOOTH CLEANING UNIT WITH HANDLE

[76] Inventor: Rene G. Hashey, 116 Hanlon Rd., Holliston, Mass. 01746

[21] Appl. No.: 09/190,574

[22] Filed: Nov. 12, 1998

[51] Int. Cl.[7] ..... A46B 5/04

[52] U.S. Cl. ..... 15/104.94; 15/167.1; 15/227

[58] Field of Search ..... 15/104.94, 227, 15/167.1

[56] References Cited

U.S. PATENT DOCUMENTS

| | | |
|---|---|---|
| 1,200,596 | 10/1916 | Daly . |
| 2,075,681 | 3/1937 | Welker . |
| 3,298,507 | 1/1967 | Micciche . |
| 4,620,528 | 11/1986 | Arraval . |
| 5,107,562 | 4/1992 | Dunn . |
| 5,213,428 | 5/1993 | Salman . |
| 5,348,153 | 9/1994 | Cole . |
| 5,392,482 | 2/1995 | Drulias et al. . |
| 5,636,405 | 6/1997 | Stone et al. . |
| 5,826,599 | 10/1998 | Adams . |
| 5,875,513 | 3/1999 | Reinold . |
| 5,909,739 | 6/1999 | Masrour-Rad . |
| 5,953,783 | 9/1999 | Hahn . |

FOREIGN PATENT DOCUMENTS

| | | |
|---|---|---|
| 711954 | 7/1931 | France . |
| 510572 | 10/1930 | Germany . |

*Primary Examiner*—Terrence R. Till
*Assistant Examiner*—Jennifer McNeil

[57] ABSTRACT

A finger mounted tooth cleaning system is provided including a sleeve with a tooth cleaner mounted thereon. A toothpaste material is contained on the tooth cleaner for being dispensed during use.

8 Claims, 3 Drawing Sheets

14
12
3
16
18
3

26
12

14

12
6
20
6
14

DISPOSABLE FINGER-MOUNTED TOOTH CLEANING UNIT WITH HANDLE

BACKGROUND OF THE INVENTION

1. Field of the Invention

The present invention relates to toothbrushes and more particularly pertains to a new disposable finger-mounted tooth cleaning unit with handle for cleaning teeth of a user with an easily held and manipulated disposable device.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,077,540; 5,636,405; U.S. Patent Des. 136,631; U.S. Patent Des. 313,317; U.S. Pat. Nos. 4,134,172; and 5,068,941.

In these respects, the disposable finger-mounted tooth cleaning unit with handle according to the present invention substantially departs from the conventional concepts and designs of the prior art, and in so doing provides an apparatus primarily developed for the purpose of cleaning teeth of a user with an easily held and manipulated disposable device.

SUMMARY OF THE INVENTION

In view of the foregoing disadvantages inherent in the known types of toothbrushes now present in the prior art, the present invention provides a new disposable finger-mounted tooth cleaning unit with handle construction wherein the same can be utilized for cleaning teeth of a user with an easily held and manipulated disposable device.

The general purpose of the present invention, which will be described subsequently in greater detail, is to provide a new disposable finger-mounted tooth cleaning unit with handle apparatus and method which has many of the advantages of the toothbrushes mentioned heretofore and many novel features that result in a new disposable finger-mounted tooth cleaning unit with handle which is not anticipated, rendered obvious, suggested, or even implied by any of the prior art toothbrushes, either alone or in any combination thereof.

To attain this, the present invention generally comprises a sleeve constructed from a flexible, elastic latex material or any other type of plastic or paper material. The sleeve preferably has a generally cylindrical configuration with a closed hemispherical outboard end and an open inboard end. Ideally, a diameter of the sleeve decreases from the inboard end to the outboard end thereof. Also included is a handle including a planar rectangular strip constructed from a material similar to that from which the sleeve is constructed. The handle has a distal end with a semicircular configuration, a pair of elongated linear parallel side edges, and a proximal end. The proximal end is integrally coupled to the inboard end of the sleeve along a first side extent thereof. Ideally, a length of the handle is equal to that of the sleeve. As such, the handle is adapted for being gripped by a user such that the same remains at an angle with respect to an axis of the sleeve. As shown in FIGS. 1 & 3, the first side extent of the sleeve may be equipped with a piece of cloth which is impregnated with a powdered toothpaste which is activated when exposed to water. In the alternative, a plurality of hemispherical nibs are provided each having a lower peripheral edge integrally coupled to the first side extent of the sleeve such that the nibs define a matrix. This matrix preferably covers an entirety of the first side extent of the sleeve, as shown in FIG. 5. The nibs are preferably lined with toothpaste material. Finally, a conical tooth pick is constructed from a material similar to that from which the sleeve is constructed. As shown in FIG. 2, the conical tooth pick has a base integrally and centrally coupled to a second side extent of the sleeve adjacent to the outboard end thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new disposable finger-mounted tooth cleaning unit with handle apparatus and method which has many of the advantages of the toothbrushes mentioned heretofore and many novel features that result in a new disposable finger-mounted tooth cleaning unit with handle which is not anticipated, rendered obvious, suggested, or even implied by any of the prior art toothbrushes, either alone or in any combination thereof.

It is another object of the present invention to provide a new disposable finger-mounted tooth cleaning unit with handle which may be easily and efficiently manufactured and marketed.

It is a further object of the present invention to provide a new disposable finger-mounted tooth cleaning unit with handle which is of a durable and reliable construction.

An even further object of the present invention is to provide a new disposable finger-mounted tooth cleaning unit with handle which is susceptible of a low cost of manufacture with regard to both materials and labor, and which accordingly is then susceptible of low prices of sale to the consuming public, thereby making such disposable finger-mounted tooth cleaning unit with handle economically available to the buying public.

Still yet another object of the present invention is to provide a new disposable finger-mounted tooth cleaning unit with handle which provides in the apparatuses and methods of the prior art some of the advantages thereof, while simultaneously overcoming some of the disadvantages normally associated therewith.

Still another object of the present invention is to provide a new disposable finger-mounted tooth cleaning unit with handle for cleaning teeth of a user with an easily held and manipulated disposable device.

Even still another object of the present invention is to provide a new disposable finger-mounted tooth cleaning unit with handle that includes a sleeve with a tooth cleaner mounted thereon. A toothpaste material is contained on the tooth cleaner for being dispensed during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
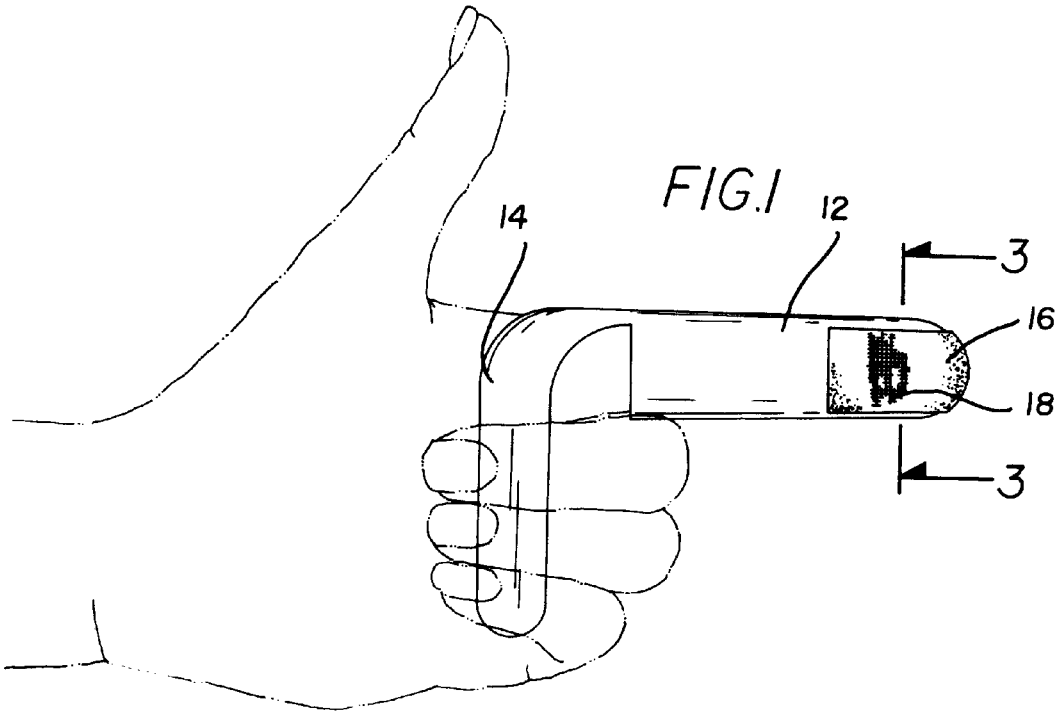
FIG. 1 is a side view of a new disposable finger-mounted tooth cleaning unit with handle according to the present invention.

With reference now to the drawings, and in particular to FIGS. 1 through 5 thereof, a new disposable finger-mounted tooth cleaning unit with handle embodying the principles and concepts of the present invention and generally designated by the reference numeral 10 will be described.

The present invention, designated as numeral 10, includes a sleeve 12 constructed from a flexible, elastic latex material or any other type of plastic or paper material. The sleeve preferably has a generally cylindrical configuration with a closed hemispherical outboard end and an open inboard end. Ideally, a diameter of the sleeve decreases from the inboard end to the outboard end thereof.

Also included is a handle 14 including a planar rectangular strip constructed from a material similar to that from which the sleeve is constructed. The handle has a distal end with a semicircular configuration, a pair of elongated linear parallel side edges, and a proximal end. The proximal end is integrally coupled to the inboard end of the sleeve along a first side extent thereof. Ideally, a length of the handle is equal to that of the sleeve. Further, a width of the handle is preferably about ⅓ a circumference of the sleeve. As such, the handle is adapted for being gripped by a user such that the same remains at an angle with respect to an axis of the sleeve when worn.

Figure 3:
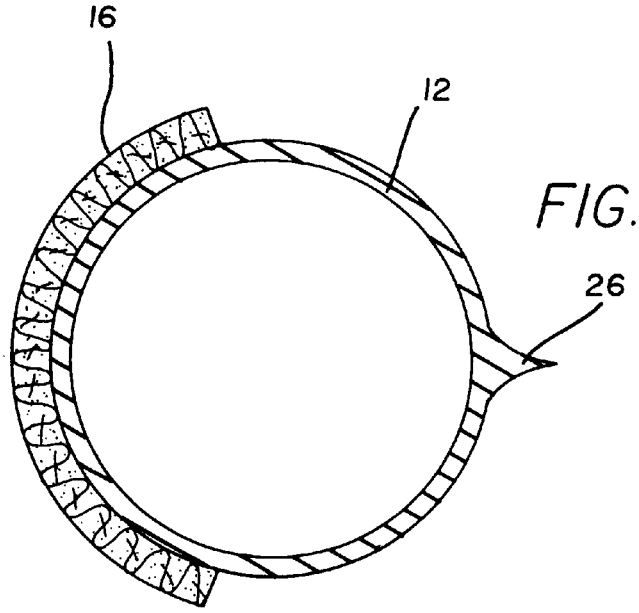
FIG. 3 is a cross-sectional view of the present invention taken along line 3—3 shown in FIG. 1.

As shown in FIGS. 1 & 3, the first side extent of the sleeve may be equipped with a piece of cloth 16 or corduroy material which is impregnated with a powdered toothpaste 18 which is activated when exposed to water. Ideally, as shown in FIG. 3, the piece of cloth has a thickness about twice that of the sleeve and encompasses ⅓–1/2 a circumference of the sleeve. Further, the piece of cloth has a length which is about ⅓ that of the sleeve. As shown in FIG. 1, the closed outboard end of the sleeve is also lined with the piece of cloth.

Figure 5:
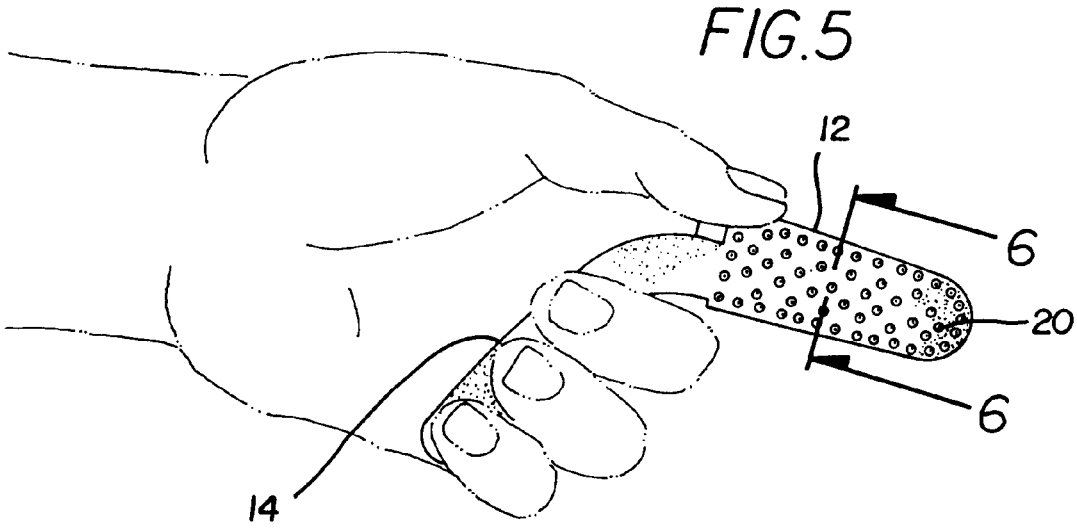
FIG. 5 is a side view of an alternate embodiment of the present invention.

In an alternate embodiment, the piece of cloth may be replaced by a plurality of hemispherical nibs 20 each constructed from a material similar to that from which the sleeve is constructed. Each nib has a lower peripheral edge integrally coupled to the first side extent of the sleeve such that the nibs define a matrix. This matrix preferably covers an entirety of the first side extent of the sleeve, as shown in FIG. 5. In the preferred embodiment, a dry or liquid toothpaste material is positioned between the nibs and covered with an unillustrated removable plastic wrap. During use, the plastic wrap may be removed for allowing the toothpaste material to be applied via the nibs.

Figure 2:
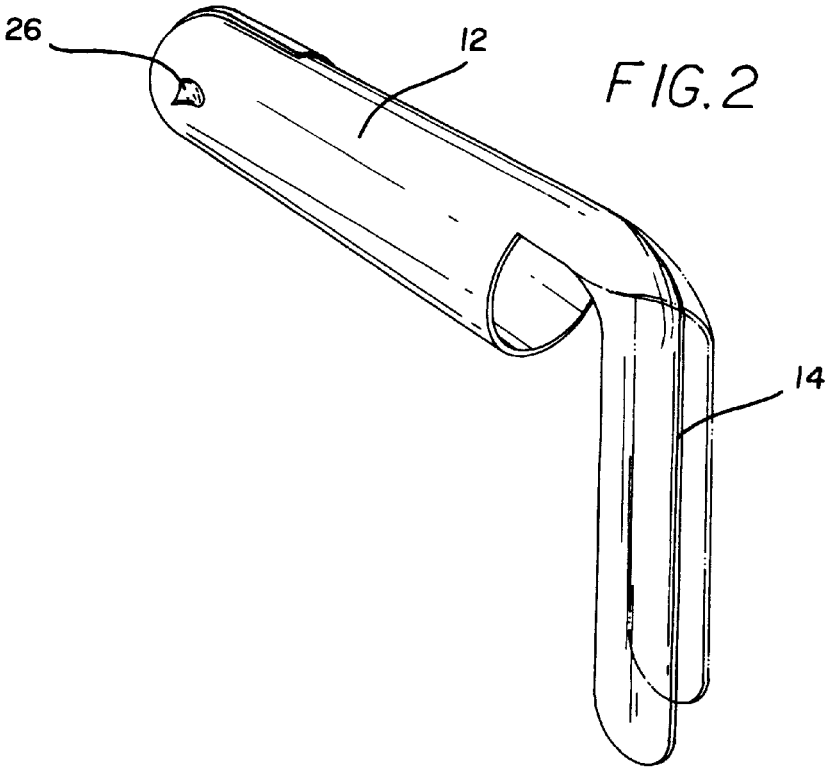
FIG. 2 is a rear perspective view of the present invention.
Figure 4:
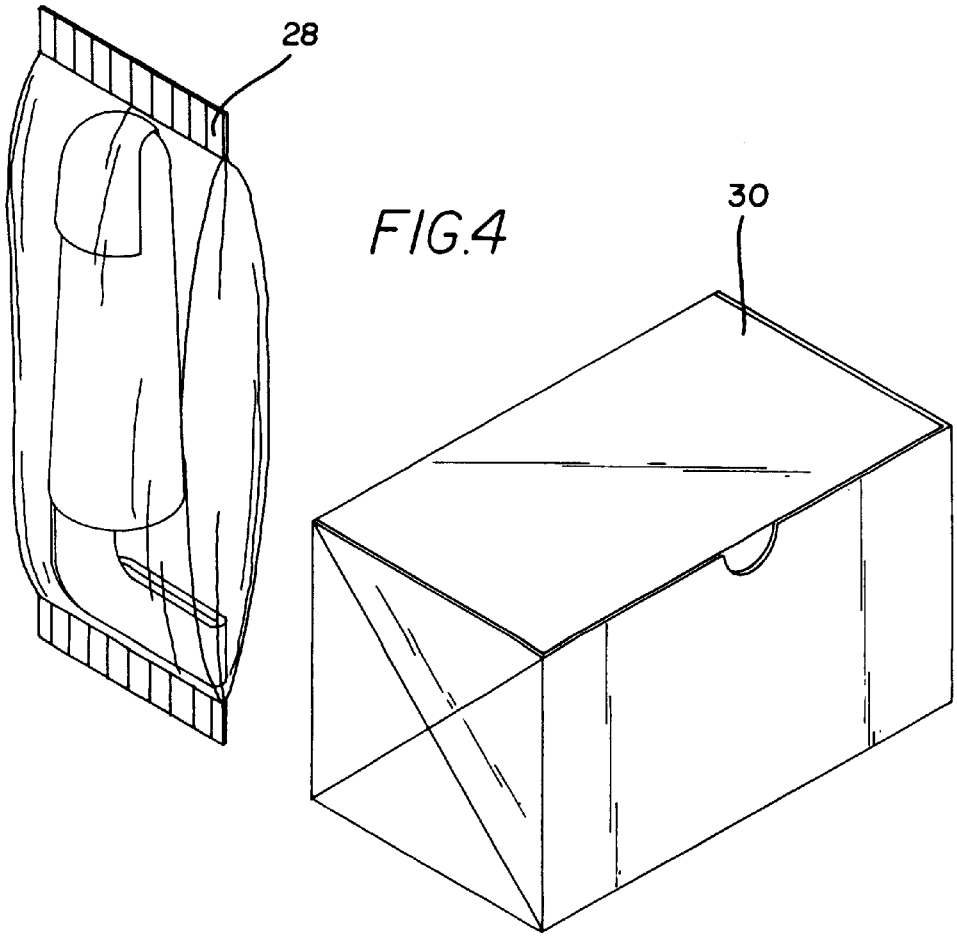
FIG. 4 is a perspective view of the various packaging associated with the present invention.

Finally, a conical tooth pick 26 is constructed from a material similar to that from which the sleeve is constructed. As shown in FIG. 2, the conical tooth pick has a base integrally and centrally coupled to a second side extent of the sleeve adjacent to the outboard end thereof. Prior to use, the present invention is preferably packaged in either a flexible transparent container 28 or a semi-rigid box 30, as shown in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finger mounted tooth cleaning system comprising:

a sleeve constructed from a flexible, elastic latex material and having a generally cylindrical configuration with a closed substantially hemispherical outboard end and an open inboard end defined by an edge, diameter of the sleeve decreasing from the inboard end to the outboard end, the sleeve having a front extent, a rear extent and first and second side extents extending between the front and rear extents;

a handle including a substantially planar rectangular strip constructed from a material similar to that from which the sleeve is constructed, the handle having a distal end with a semicircular configuration, a pair of elongated linear parallel side edges, and a proximal end of the handle being integrally coupled to a portion of the edge of the inboard end of the sleeve along the first side extent of the sleeve, the handle being formed from an elastic material such that the handle may be pulled upon to apply tension to the sleeve for retaining the sleeve on a finger of the user, the handle being formed from a flexible material such that the handle is bendable into a position at a substantially perpendicular orientation to a longitudinal axis of the sleeve for being gripped by fingers of a user with the handle being positioned in the perpendicular orientation, wherein a length of the handle is approximately equal to that of the sleeve;

a plurality of hemispherical nibs each constructed from a material similar to that from which the sleeve is constructed, each nib having a lower peripheral edge integrally coupled to the front extent of the sleeve such that the nibs define a matrix which cover an entirety of the first side extent of the sleeve, each nib further being lined with a predetermined amount of toothpaste situated thereon; and a conical tooth pick structure constructed from a material similar to that from which the sleeve is constructed and having a base integrally and centrally coupled to the rear extent of the sleeve adjacent to the outboard end thereof such that the tooth pick extends in a direction substantially opposite of a direction which the nibs extend;

whereby the handle may be positioned adjacent to one lateral side of a user's finger to position the plurality of nibs adjacent to a front pad portion of the user's finger for use and the handle may be positioned adjacent to another lateral side of the user's finger to position the tooth pick structure adjacent to the front pad portion of the user's finger for use.

2. A finger mounted tooth cleaning system comprising:

a sleeve constructed from a flexible, elastic material, the sleeve having a generally tubular configuration with a closed outboard end and an open inboard end defined by an edge, the sleeve having a front extent, a rear extent, and first and second side extents extending between the front and rear extents;

a tooth cleaner mounted on the front extent of the sleeve;

a toothpaste material contained on the tooth cleaners;

a handle including a planar strip constructed from a material similar to that from which the sleeve is constructed, the handle having a distal end, a pair of elongated linear parallel side edges, and a proximal end of the handle being integrally coupled to a portion of the edge of the inboard end of the sleeve along a first side extent of the sleeve, the handle being formed from an elastic material such that the handle may be pulled upon to apply tension to the sleeve for retaining the sleeve on a finger of the user, the handle being formed from a flexible material such that the handle is bendable into a position at a substantially perpendicular orientation to a longitudinal axis of the sleeve for being gripped by fingers of a user with the handle being positioned in the perpendicular orientation.

3. A finger mounted tooth cleaning system as set forth in claim 2 wherein the sleeve is constructed from a latex material.

4. A finger mounted tooth cleaning system as set forth in claim 2 wherein the tooth cleaner includes a plurality of nibs with a predetermined amount of the toothpaste material situated therebetween.

5. A finger mounted tooth cleaning system as set forth in claim 2 wherein the tooth cleaner includes a cloth material lining the sleeve.

6. A finger mounted tooth cleaning system as set forth in claim 2 and further including a tooth picking device mounted on the sleeve.

7. A finger mounted tooth cleaning system as set forth in claim 6 wherein the tooth picking device is positioned on a side of the sleeve opposite from that on which the tooth cleaner is positioned.

8. A finger mounted tooth cleaning system as set forth in claim 2 wherein the sleeve has a front extent, a rear extent, and the first side extent and a second side extent extending between the front and rear extents wherein the tooth cleaner is positioned on the front extent of the sleeve, wherein the tooth cleaner includes a plurality of nibs with a predetermined amount of the toothpaste material situated therebetween, wherein the tooth cleaner includes a cloth material lining the sleeve, wherein a tooth picking device is formed on the rear extent of the sleeve opposite from the plurality of nibs formed on the front extent, whereby the handle may be positioned adjacent to one lateral side of a user's finger to position the plurality of nibs adjacent to a front pad portion of the user's finger for use and the handle may be positioned adjacent to another lateral side of the user's finger to position the tooth pick structure adjacent to the front pad portion of the user's finger for use.

* * * * *